US010477952B2

(12) United States Patent
Jimenez et al.

(10) Patent No.: US 10,477,952 B2
(45) Date of Patent: Nov. 19, 2019

(54) ORAL CARE IMPLEMENT

(71) Applicant: Colgate-Palmolive Company, New York, NY (US)

(72) Inventors: Eduardo Jimenez, Manalapan, NJ (US); Kenneth Waguespack, North Brunswick, NJ (US); Douglas Hohlbein, Hopewell, NJ (US); Anthony Baxter, Upper Montclair, NJ (US); Marisol Rodriguez, New York, NY (US); Alberto Mantilla, Rego Park, NY (US); Ellis Junior Smith, New York, NY (US); Chad Leighton Helland, New York, NY (US); Dario Alejandro Narvaez Lopez, North Bergen, NJ (US); Mauricio Issa, New York, NY (US)

(73) Assignee: Colgate-Palmolive Company, New York, NY (US)

( * ) Notice: Subject to any disclaimer, the term of this patent is extended or adjusted under 35 U.S.C. 154(b) by 82 days.

(21) Appl. No.: 15/766,602

(22) PCT Filed: Oct. 9, 2015

(86) PCT No.: PCT/US2015/054928
§ 371 (c)(1),
(2) Date: Apr. 6, 2018

(87) PCT Pub. No.: WO2017/062033
PCT Pub. Date: Apr. 13, 2017

(65) Prior Publication Data
US 2018/0289143 A1 Oct. 11, 2018

(51) Int. Cl.
*A46B 9/04* (2006.01)
*A46B 5/00* (2006.01)
*A46B 7/02* (2006.01)

(52) U.S. Cl.
CPC ..... *A46B 9/04* (2013.01); *A46B 5/0037* (2013.01); *A46B 5/0075* (2013.01); *A46B 7/02* (2013.01); *A46B 2200/1066* (2013.01)

(58) Field of Classification Search
CPC ..... A46B 9/04; A46B 5/0037; A46B 5/0075; A46B 7/02; A46B 2200/1066
See application file for complete search history.

(56) References Cited

U.S. PATENT DOCUMENTS 2,004,633 A 6/1935 Miller
2,427,411 A 9/1947 Krueger
(Continued)

FOREIGN PATENT DOCUMENTS

DE 283892 4/1915
DE 9318148 3/1994
(Continued)

OTHER PUBLICATIONS

International Search Report and Written Opinion of the International Searching Authority in International Application No. PCT/US2015/054928, dated Jun. 3, 2016.

*Primary Examiner* — Weilun Lo

(57) ABSTRACT

An oral care implement in one embodiment includes an elongated body comprising a head portion supporting plurality of tooth cleaning elements and a handle portion. The tooth cleaning elements are disposed on longitudinally extending bristle carrier sections hingedly coupled together about a common pivot axis. The axis may be formed by a flexible web. A slidable actuator mounted in the handle portion is mechanically coupled to the bristle carrier assembly by an elongated operating rod. Moving the actuator in opposing rearward and forward directions opens or folds the bristles on the carriers outwards or inwards respectively about the common pivot axis. In the folded position, the bristles are configured for interdental cleaning of the teeth.
(Continued)

In the open or extended position, the bristles are configured for general purpose cleaning of the teeth.

19 Claims, 7 Drawing Sheets

(56) References Cited

U.S. PATENT DOCUMENTS

| | | | | | |
|---|---|---|---|---|---|
| 3,680,169 | A * | 8/1972 | Thompson | A46B 7/02 | 15/176.1 |
| 4,409,701 | A * | 10/1983 | Perches | A46B 7/02 | 15/106 |
| 4,783,874 | A * | 11/1988 | Perches | A46B 7/02 | 15/167.1 |
| 5,228,466 | A | 7/1993 | Klinkhammer | | |
| 5,284,168 | A | 2/1994 | Klinkhammer | | |
| 5,350,248 | A * | 9/1994 | Chen | A46B 7/02 | 15/167.1 |
| 5,357,644 | A * | 10/1994 | Theriault | A46B 7/02 | 15/167.1 |
| 5,497,526 | A | 3/1996 | Klinkhammer | | |
| 5,839,149 | A | 11/1998 | Scheier et al. | | |
| 6,785,928 | B2 | 9/2004 | Specht et al. | | |
| 7,360,270 | B2 | 4/2008 | Moskovich et al. | | |
| 8,020,244 | B2 | 9/2011 | Mashiko | | |
| 8,239,995 | B2 | 8/2012 | Chenvainu et al. | | |
| 8,499,402 | B1 * | 8/2013 | Arsenault | A46B 9/04 | 15/167.1 |
| 2004/0040571 | A1 | 3/2004 | Williams et al. | | |
| 2005/0172436 | A1 | 8/2005 | Wineberg | | |
| 2009/0064435 | A1 | 3/2009 | Fukugaki et al. | | |
| 2014/0053357 | A1 * | 2/2014 | Barzel | A46B 5/0025 | 15/167.1 |

FOREIGN PATENT DOCUMENTS

| | | |
|---|---|---|
| FR | 2502918 | 10/1982 |
| FR | 2558355 | 7/1985 |
| KR | 101456623 | 11/2013 |
| WO | 2003/001942 | 1/2003 |

* cited by examiner

ORAL CARE IMPLEMENT

BACKGROUND

The present invention relates to oral care implements, and more particularly to a toothbrush with foldable bristles.

The basic toothbrush is typically provided with tooth cleaning elements such as bristles which are fixed in orientation at a single angle with respect to the head of the brush. While this may be appropriate for general purpose cleansing of tooth surfaces, it is desirable to provide a toothbrush which is capable of more than one cleansing mode of operation to enhance the effectiveness of the brushing regimen and oral health.

BRIEF SUMMARY

The present invention provides an oral care implement comprising toothbrush head system with two position-adjustable sections of tooth cleaning elements for general purpose ("all-around") cleaning and interdental cleaning between teeth. The toothbrush head in one implementation thus may include a bristle carrier assembly comprising two separate angularly-movable and adjustable bristle carrier sections and an actuator mechanism that collectively provides at least two user-selectable modes of tooth cleaning depending on the configuration of the tooth cleaning elements selected. In a first general purpose cleaning mode when the actuator is not activated by the user (i.e. inactive), the toothbrush head is configured as a standard toothbrush head with generally upright bristles and/or other elements. In a second interdental cleaning mode when the actuator is activated by the user, the toothbrush head is configured as an interdental toothbrush head with obliquely oriented bristles and/or other elements forming a wedge shaped set of bristles for optimum cleaning between teeth. An actuator which may be in the form of a slidable button in some non-limiting embodiments or another type actuator is mounted on the body of the toothbrush (e.g. handle and/or neck) for selectively switching the toothbrush between the cleaning and interdental operating modes and bristle configurations. This narrower brush configuration provides improved cleaning between teeth by transforming the normally parallel tufts or sets of bristles into a "wedge" shaped set of bristles to reach deeper into gaps between teeth for removing debris and plaque.

In one embodiment, an oral care implement comprises: an elongated body extending along a longitudinal axis and comprising a head portion and a handle portion; a first bristle carrier section movably disposed on the head portion, the first bristle carrier section comprising a plurality of first tooth cleaning elements extending outward from a front surface thereof; a second bristle carrier section movably disposed on the head portion adjacent the first bristle carrier section, the second bristle carrier section comprising a plurality of second tooth cleaning elements extending outward from a front surface thereof; the first and second bristle carrier sections hingedly coupled together about a common pivot axis; and an actuator operably coupled to the first and second bristle carrier sections, the actuator alterable between: (1) a first state in which the actuator causes the first and second bristle carrier sections to assume an extended position; and (2) a second state in which the actuator causes the first and second bristle carrier sections to assume a transversely folded position in which the first and second tooth cleaning elements converge.

In another embodiment, an oral care implement comprises: an elongated body extending along a longitudinal axis and comprising a head portion defining a distal end, a handle portion defining a proximal end, and a neck portion extending therebetween; a foldable bristle carrier assembly comprising first and second bristle carrier sections hingedly coupled together by a flexible web; an actuator operably coupled to the bristle carrier assembly, the actuator alterable between a first state and a second state; wherein moving the actuator from the first state to the second state causes the first and second bristle carrier sections to pivot inwards about the flexible web to a folded position; and wherein moving the actuator from the second state to the first state causes the first and second bristle carrier sections to pivot outwards about the flexible web to an upright open position.

A method for operating an oral care implement with angularly adjustable bristles is provided. The method includes: a) providing an elongated oral care implement comprising a longitudinal axis, a head defining a distal end, a handle defining a proximal end, a foldable bristle carrier assembly comprising first and second bristle carrier sections each having a plurality of bristles and hingedly coupled together about a common pivot axis, and an actuator operably coupled to the bristle carrier assembly; b) placing the actuator in a first state, thereby causing the bristles of the first and second bristle carrier sections to be oriented substantially perpendicular to the head of the oral care implement; and c) altering the actuator to a second state, thereby causing each of the first and second bristle carrier sections to pivot inwards about the common pivot axis so that the bristles of the first and second bristle carrier sections assume a wedge-shaped folded position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1A:
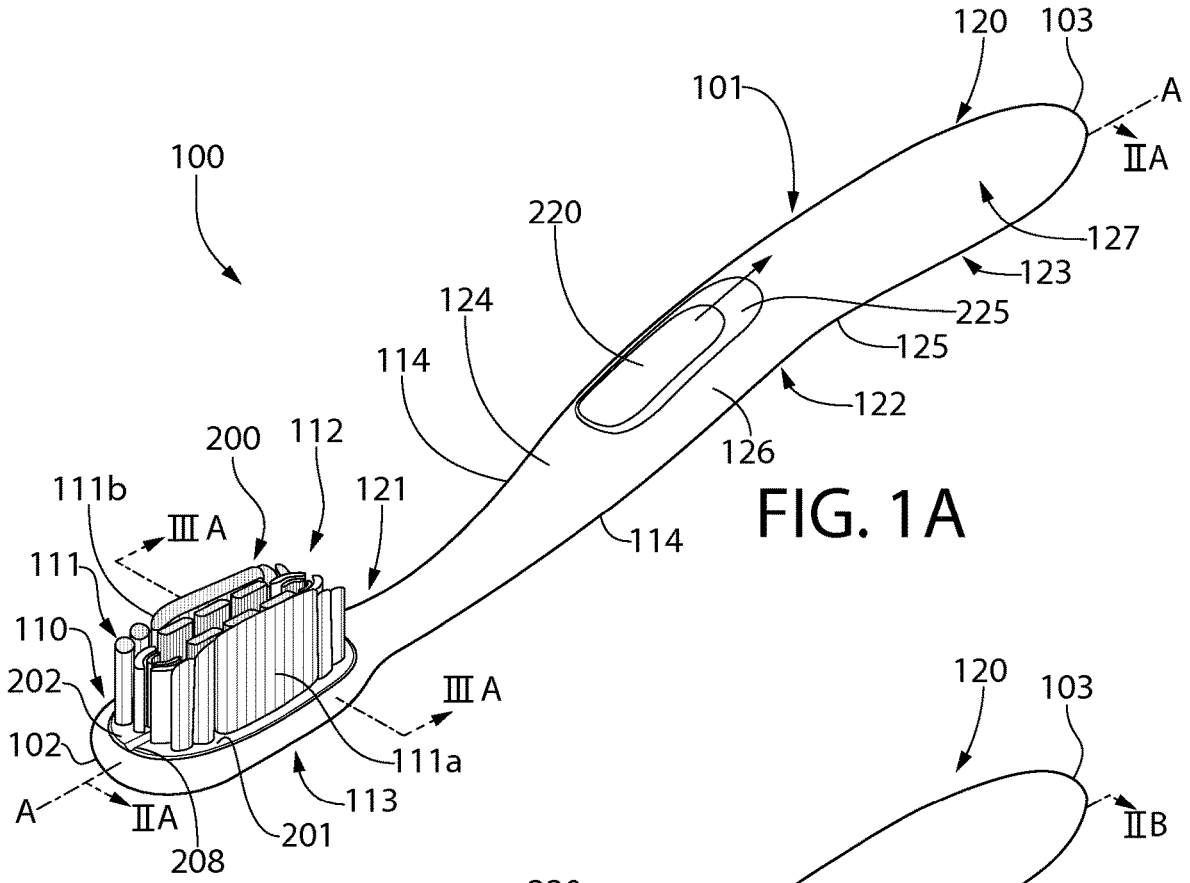
FIG. 1A is a front perspective view of an oral care implement according to one embodiment of the present invention, the bristle carriers and bristles being shown in an open or extended position.

All drawing are schematic and not necessarily to scale.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Referring to FIGS. 1-3, a non-limiting embodiment of an oral care implement according to the present disclosure may be a toothbrush 100. Toothbrush 100 generally includes an elongated body 101 extending from a proximal end 103 to a distal end 102 along a longitudinal axis A-A. The body 101 includes a front side 112, opposing rear side 113, and opposing lateral sides 114 extending between the front and rear sides. A vertical plane drawn through the longitudinal axis A-A from the distal to proximal ends 102, 103 and normal to the front side 112 of the body divides the body 101 of the toothbrush 100 into a right side and left side if viewed looking at the front side of the body in an upright position (i.e. distal end 102 up and proximal end 103 down).

The longitudinal axis A-A follows the contours and shapes of the toothbrush body 101 from proximal to distal ends 103, 102 and remains at the centerline of each transverse section of the body through which the longitudinal axis extends. Accordingly, the longitudinal axis A-A is not necessarily a straight reference line in all cases depending on the shape and curvature of the toothbrush body.

Body 101 further comprises a head portion 110 (alternatively "head"), a handle portion 120 (alternatively "handle"), and a neck portion 121 (alternatively "neck") coupling the handle to head. In certain embodiments, neck portion 121 may a structure that is narrower in width and/or height (measured transversely to longitudinal axis A-A than the head portion 110 and/or handle portion 120.

The front side 112 of the head portion 110 may be substantially planar in one embodiment when the user-configurable toothbrush 100 is in the normal general tooth cleaning operating mode, as further described herein. The head portion 110 comprises a plurality of tooth cleaning elements such as bristles 111 extending transversely from the front side 112. The exact types, structure, pattern, orientation and material of the tooth cleaning elements is not limiting of the present invention unless so specified in the claims. As used herein, the term "tooth cleaning elements" is used in a generic sense to refer to any structure or combination of structures that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The bristles 111 of the present invention can be connected to the head portion 110 in any manner now available or to be developed and is also not limiting of the invention. For example, staples/anchors, in-mold tufting (IMT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

In certain embodiments, the head portion 110 may also include a soft tissue cleanser (not shown herein) coupled to or positioned on its rear side 113. An example of a suitable soft tissue cleanser that may be used with the present invention and positioned on the rear surface of the head portion 110 is disclosed in U.S. Pat. No. 7,143,462, issued Dec. 5, 2006 to the assignee of the present application, the entirety of which is hereby incorporated by reference. In certain embodiments, the soft tissue cleanser may include a plurality of protuberances, which can take the form of elongated ridges, nubs, or combinations thereof. Of course, the invention is not to be so limited and in certain embodiments the oral care implement 100 may not include any soft tissue cleanser.

In the exemplified embodiment, the head portion 110 is formed integrally with the handle portion 120 and neck portion 121 as a single unitary structure using a molding, milling, machining, and/or other suitable process. However, in other embodiments the handle portion 120, neck portion 121, and head portion 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In certain embodiments, the head and neck portions 110, 121 may be formed as a detachable single unitary structure which is configured for removable coupling to the handle portion 120, thereby allowing the head to be replaceable when the bristles 111 have worn.

With continuing reference to FIGS. 1-3, the handle portion 120 is an axially elongated structure extending from the proximal end 103 of the body 101 to the neck portion 121 that provides a means for grasping and manipulating the toothbrush 100 during use. The handle portion 120 may comprise an ergonomic thumb grip section 122 adjacent neck portion 121 and a finger grip section 123 disposed more proximally. The thumb grip section 122 is located between the neck portion 121 and the finger grip section 123. Handle portion 120 further defines a front surface 124, an opposing rear surface 125, and two opposing lateral side surfaces 126. Surfaces 124-126 collectively form an outer surface 127 of the handle portion 120.

In the exemplified embodiment, the handle portion 120 is generically depicted having various contours for user comfort. More specifically, in the exemplified embodiment the thumb grip section 122 of the handle portion 120 is a more bulbous diametrically enlarged structure relative to the outer surface 127 of and other portions of the handle portion 120. Thus, thumb grip section 122 may have a diameter and width measured transversely to longitudinal axis A-A between lateral sides 126 of the handle portion 120 that is greater than a width of the finger grip section 123 of the handle portion. Of course, the invention is not to be so limited in all embodiments, and in certain other embodiments the thumb grip section 122 may not have a greater width than the entire or at least portions of the finger grip section 123. For example, the proximal portion of the finger grip section 123 may be bulbous shaped and wider than other portions of the finger grip section in addition to or instead of the thumb grip section 122. The handle portion 120 can therefore take on a wide variety of shapes, contours and configurations, none of which are limiting of the present invention unless so specified in the claims.

In the exemplified embodiment, the handle portion 120 of toothbrush 100 which may be made of a rigid plastic material, such as for example without limitation polymers and copolymers of ethylene, propylene, butadiene, vinyl compounds and polyesters such as polyethylene terephthalate. Of course, the invention is not to be so limited in all embodiments and the handle portion 120 may be formed with a semi-rigid material. Handle portion 120 may further include surface portions which are formed of a non-slip resilient material for greater comfort and handling, such as without limitation a thermoplastic elastomer (TPE) affixed over portions of or the entirety of the handle portion 120 to enhance grip of the toothbrush during use. For example, parts of the handle portion 120 that are typically gripped by a user's palm, fingers, and/or thumb during use, such as the finger grip section 123 and thumb grip section 122, may be partially or totally overmolded with a thermoplastic elastomer or other resilient material to further increase comfort and grip for a user.

According to one aspect of the invention, toothbrush 100 includes user-configurable sets of bristles and/or other tooth cleaning elements that transform the toothbrush from a general purpose oral care implement into an interdental implement when desired by the user. Advantageously, this supplants the need to purchase and use two separate oral care devices for performing general cleaning of the teeth and specialized deep cleaning in the interdental spaces between teeth. The structure and operation of this aspect of toothbrush 100 will now be described in further detail.

Figure 1B:
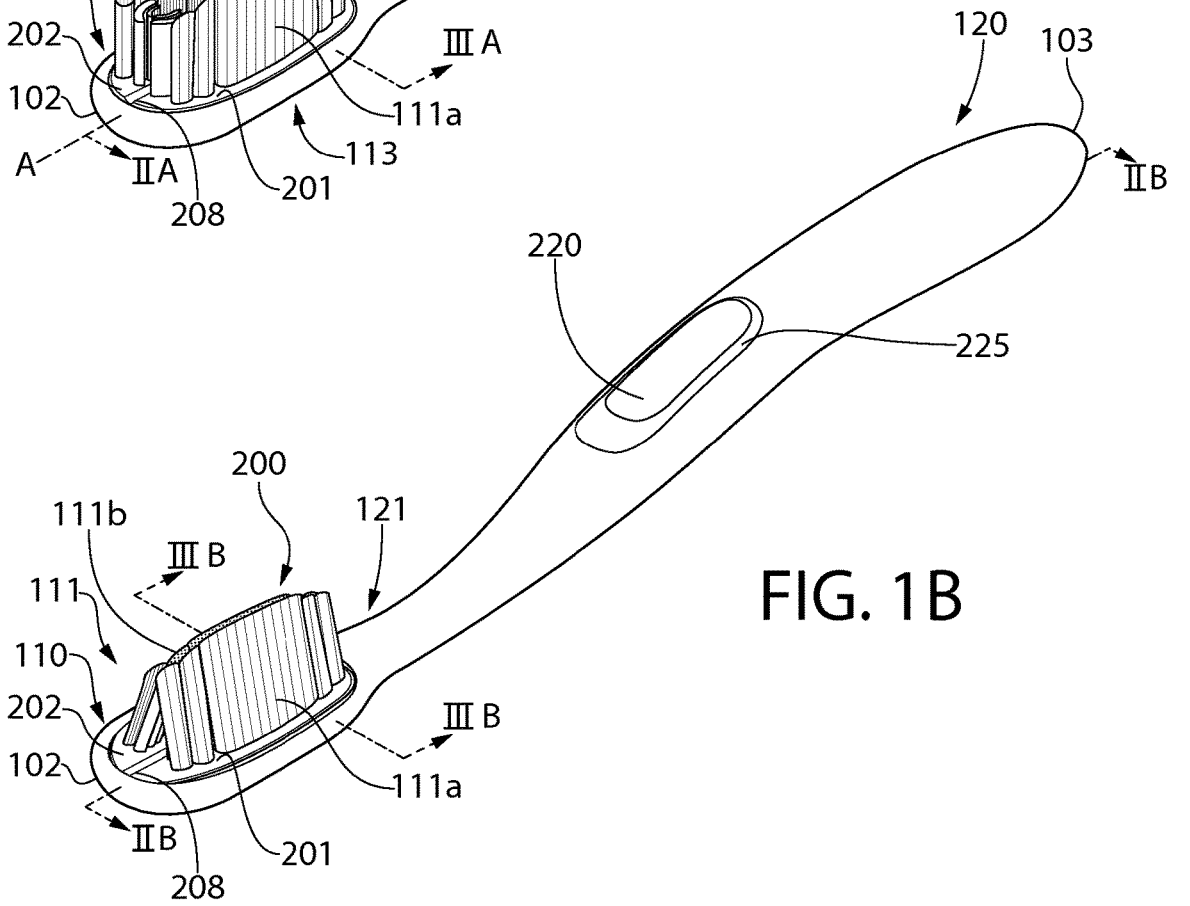
FIG. 1B is front perspective view thereof showing the bristle carriers and bristles in a folded position.
Figure 2A:
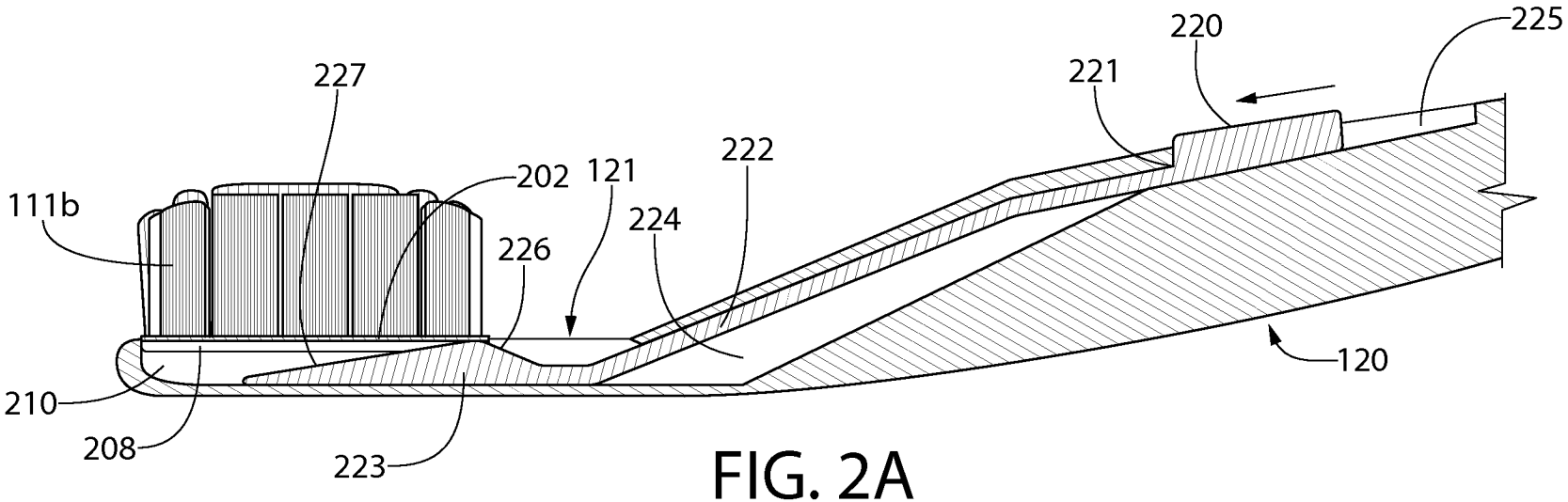
FIG. 2A is a partial longitudinal cross-sectional view thereof showing an actuator in a forward position and the bristle carriers and bristles in the open/extended position.
Figure 2B:
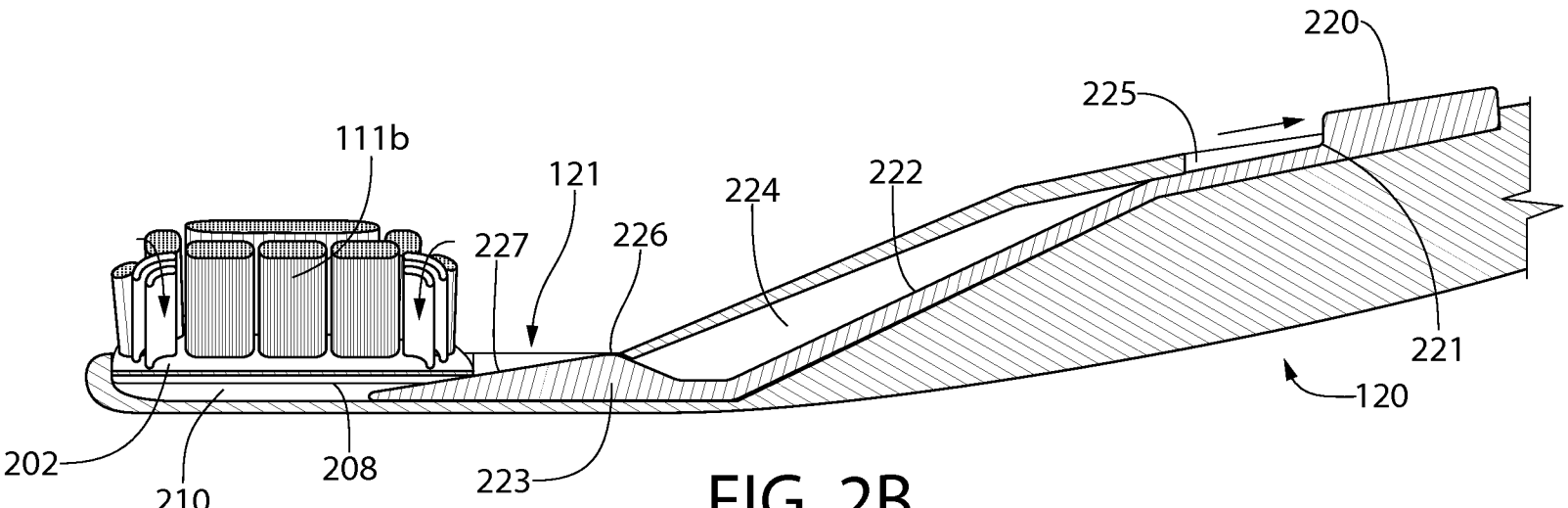
FIG. 2B is a partial longitudinal cross-sectional view thereof showing the actuator in a rearward position and the bristle carriers and bristles in the folded position.
Figure 3A:
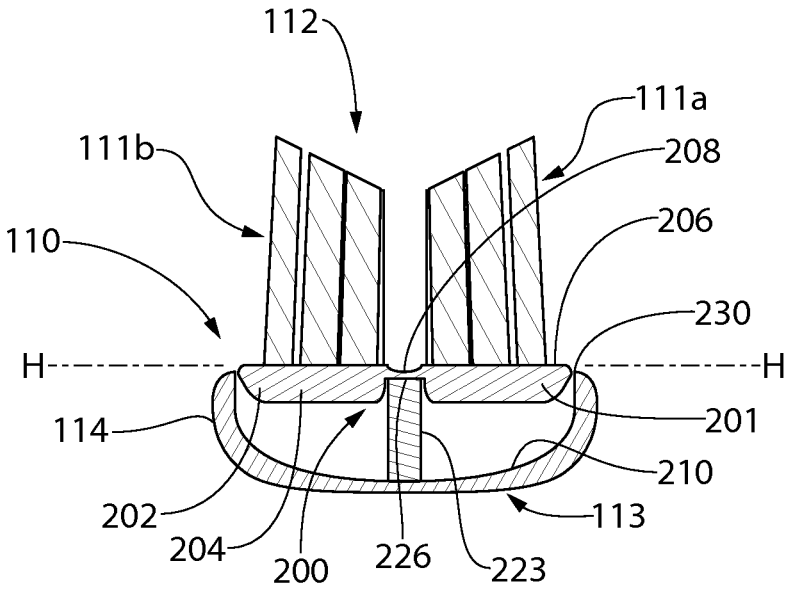
FIG. 3A is a transverse cross-sectional view of the head portion of the oral care implement showing the bristle carriers and bristles in the open/extended position.

Referring to FIGS. 1-3, the head portion 110 includes a bristle carrier assembly 200 comprising a longitudinally-extending first bristle carrier section 201 and second bristle carrier section 202 disposed adjacent the first section. Bristle carrier sections 201, 202 each comprise a respective base 204 that supports a plurality of bristles 111 including a first set of bristles 111*a* disposed on carrier section 201 and second set of bristles 111*b* disposed on carrier section 202. In one non-limiting embodiment, a front surface 206 is formed by bases 204 for each bristle carrier section 201, 202 which may be substantially planar or flat as illustrated. In other embodiments, the front surface 206 may be convexly or concavely curved or undulating. The bristles extend vertically upward and outwards from the front surfaces 206 of the bases 204 in a generally perpendicular direction to a horizontal reference plane H-H defined by opposing front lateral peripheral edges 230 on the front side of the toothbrush head portion 110. The front surfaces 206 of bases 204 when arranged parallel to each other and horizontal reference plane H-H as shown in FIG. 3A define an open or extended position of the bristle carrier assembly 200 and a general purpose cleaning configuration of the bristles. In other embodiments, it should be noted that some of the bristles may be obliquely angled to front surfaces 206 of the bases 204 while others are oriented perpendicular. The bottom lower ends of bristles in each set of bristles 111*a*, 111*b* is secured to a base 204 by methods already described herein for bristle tuft attachment. The top upper free ends of the bristles may have any suitable shape including obliquely angled, straight/flat, tapered, or other.

Bristle carrier sections 201 and 202 are hingedly coupled together by a thin flexible web 208 which extends axially between the sections parallel to longitudinal axis A-A of the toothbrush 100. Web 208 adjoins the inner edges of bristle carrier sections 201 and 202 and the outer edges of the bristle carrier sections adjoins the front lateral peripheral edges 230 on the front side of the toothbrush head portion 110. In one non-limiting embodiment, web 208 has a transverse thickness less than the thickness of the carrier section bases 204 (see, e.g. FIGS. 3A and 3B) to impart greater flexibility to the assembly at the web. Accordingly, the bases 204 are structured to be more rigid than the flexible web 208. This forms a "living hinge" in which the bristle carrier section bases 204 and web 208 may be integrally formed from a single monolithic and unitary plastic component by a suitable molding process. It bears noting that a "living hinge" is a well-known term of art used to describe a thin flexible hinge made from the same base material as the two more rigidly structured hinged parts that it connects. In one embodiment, the bristle carrier assembly 200 collectively including the carrier sections 201, 202 and web 208 may be structured and made of a relatively rigid or semi-rigid plastic material, such as for example without limitation polymers and copolymers of ethylene, propylene, butadiene, vinyl compounds and polyesters such as polyethylene terephthalate.

The flexible web 208 in one embodiment is aligned and arranged in a vertical reference plane that includes the longitudinal axis and is orthogonal to the front surfaces 206 of the first and second bristle carrier sections 201, 202. The first and second bristle carrier sections 201, 202 are located on opposite sides of the vertical reference plane.

Figure 3B:
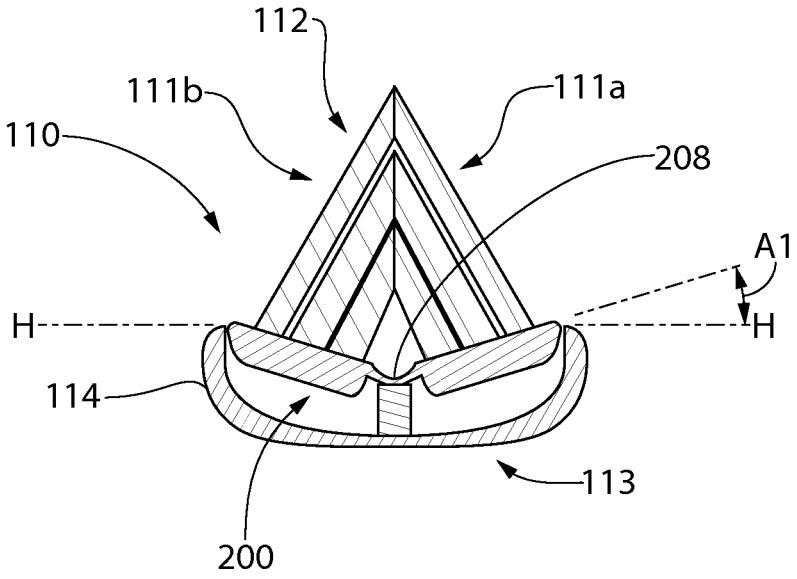
FIG. 3B is a transverse cross-sectional view of the head portion showing the bristle carriers and bristles in the folded position.

With continuing reference to FIGS. 1-3, the bristle carrier sections 201, 202 are supported by the head portion 110 in a manner which allows tilting or folding movement transverse to the longitudinal axis A-A about the flexible web 208. The web 208 thus defines a common pivot axis oriented parallel to longitudinal axis A-A of the toothbrush body 101. The bases 204 of the bristle carrier sections 201, 202 span and extend across a recessed basin 210 formed in the front side 112 of the toothbrush head portion 110 (best shown in FIGS. 3A-B). A gap is formed between the underside of the bases 204 and floor of the basin 210. This provides space that allows partial collapse of the carrier sections 201, 202 into the basin 210 and insertion of an actuator beneath the carrier sections, as further described herein. The actuator is operably coupled to the carrier assembly to cause the first and second bristle carrier sections 201, 202 to assume an extended position (i.e. general purpose cleaning configuration) and a folded/collapsed position (i.e. interdental cleaning bristle configuration), Referring to FIGS. 1-3, a manual actuating mechanism is provided in one non-limiting embodiment for articulating the bristle carrier sections 201, 202 between an extended position in which the bristles have an upright parallel configuration for general purpose cleaning (see, e.g. FIG. 3A) and a folded/collapsed position in which the bristles have an obliquely angled configuration for interdental cleaning (see, e.g. FIG. 3B). The actuating mechanism includes a longitudinally-extending and elongated operating rod 222 including an actuator 220 disposed at a proximal operating end 221 of the rod and a distal working end 223 engageable with the bristle carrier sections 201, 202. Operating rod 222 is slidably disposed in an axially elongated cavity 224 formed inside the toothbrush 100 between the head portion 110 and handle portion 120 that extends through the neck portion 121 of the toothbrush (best shown in FIGS. 2A-B). Cavity 224 opens into and is in communication with the basin 210 of the toothbrush head portion 110. The actuator 220 may be in the form of a button or slide that is movably disposed in an axially elongated and upwardly open recess 225 formed in front surface 124 of the handle. The operating rod 222 may have any suitable shape adapted to fit the contours of the handle and neck of the toothbrush.

The working end 223 of the operating rod 222 includes an upwardly extending protrusion 226 which is selectively engageable with the bristle carrier assembly. In one embodiment, protrusion 226 is axially aligned to and parallel with the longitudinal axis A-A to engage the flexible web 208 of the bristle carrier assembly 200 also aligned with longitudinal axis. The working end 223 and protrusion 226 may have any suitable shape. In one non-limiting example, working end 223 may be wedge shaped having a generally triangular configuration in side profile with protrusion 226 defining an apex and highest portion of the working end. The operating rod 222 and actuator 220 may be integrally formed as a single unitary structure such as plastic component made by a suitable molding process. The rod preferably is structured and made of a relatively rigid or semi-rigid plastic similar to the bristle carrier sections described above to provide a positive mechanical coupling to the bristle carrier assembly 200 for articulating the sets of bristles 111*a*, 111*b*.

In operation, axial translation of the operating rod 222 in opposing longitudinal directions via the actuator 220 reconfigures the first and second bristle carrier sections 201, 202 from a standard general purpose cleaning configuration in which the sets of bristles 111*a*, 111*b* are in an extended position being arranged and oriented substantially parallel to each other (see, e.g. FIG. 3A), to an interdental cleaning configuration in which the first and second sets of bristles are in a folded/collapsed position being arranged and oriented substantially obliquely to each other (see, e.g. FIG. 3B). In this latter arrangement, the sets of bristles 111*a*, 111*b* form a wedge-shaped profile when viewed transversely to the longitudinal axis A-A and create an uppermost angled point or apex for insertion between the teeth. The free ends of the bristles 111 may touch or be in relatively close proximity to each other. FIG. 3A shows the extended (general purpose cleaning) position of the bristle carrier assembly 200 in which the bristle carrier sections 201 and 202 (and front surfaces 206) are arranged in the same horizontal reference plane H-H. FIG. 3B shows an angled or folded (interdental cleaning) position of the assembly in which the bristle carrier sections 201 and 202 (and front surfaces 206) are titled or pivoted inwards about the flexible web 208 at an angle A1 to the horizontal reference plane H-H. Angle A1 may be between 0 and 90 degrees, in some embodiments between 30 and 60 degrees. The front surfaces 206 partially face each other when in the folded position.

In the extended general purpose cleaning position shown in FIGS. 1A, 2A, and 3A, the operating rod 222 and actuator 220 are in a forward and distal-most position. The protrusion 226 on working end 223 of the rod engages the underside of the flexible web 208, thereby supporting the web and bristle carrier sections 201, 202 to prevent the assembly from collapsing inward partially into the toothbrush head basin 210. In this embodiment, the bristle carrier assembly 200 is molded such that the normal position of the assembly is the folded one shown in FIG. 3B. The bristle carrier assembly 200 is therefore biased into the folded position by the molding process; however, engagement between the working end 223 of the operating rod 222 and web 208 prevents the assembly from moving into or maintaining the folded configuration.

In the folded interdental cleaning position shown in FIGS. 1B, 2B, and 3B, the operating rod 222 and actuator 220 are in a rearward and proximal-most position. The protrusion 226 on working end 223 of the rod may be either (1) completely disengaged from the underside of the flexible web 208, or (2) the web may remain engaged with a forwardly downwardly sloping portion 227 of the working end 223 of the rod 222 forward of the protrusion 226 having a height less than the height of the portion with the protrusion 226 as shown in FIG. 2B. In either scenario, the flexible web 208 of bristle carrier assembly 200 will drop thereby pivoting the bristle carrier sections 201, 202 inward in opposite directions of rotation into the basin to form the biased wedge-shaped interdental bristle configuration. To return the bristle carrier assembly 200 to the extended general purpose cleaning position and bristle configuration, the actuator 220 is pushed forward by the user as shown in FIG. 2A to engage the protrusion 226 with the flexible web 208. It bears noting that the common pivot axis may be translated slightly in position either vertically, horizontally, or a combination thereof when the carrier assembly is moved between the extended and folded position by the actuating mechanism; however, the bristle carrier sections 201, 202 remain hingedly coupled together during this motion.

There are numerous ways to configure the actuating mechanism for articulating the bristle carrier assembly 200 between the extended position (general purpose cleaning configuration) and folded/collapsed position (interdental cleaning bristle configuration). FIGS. 1-3 show one non-limiting example of an approach for directly engaging the flexible web 208 of the assembly 200 for changing positions of the bristle carrier sections 201, 202. FIGS. 4-7 show an alternative approach for directly engaging each of the bristle carrier sections 201, 202 to change their position in lieu of engaging the flexible web 208.

Referring to FIGS. 4-7, a bristle carrier assembly 300 similarly to assembly 200 includes axially elongated bristle carrier sections 301, 302 comprising sets of bristles 111*a*, 111*b* respectively, and a flexible web 308 hingedly and pivotably coupling the sections 301, 302 together. Web 308 is axially elongated and oriented parallel to longitudinal axis A-A to permit the bristle carrier sections 301, 302 to rotate transversely to the longitudinal axis in a lateral direction from side-to-side similarly to bristle carrier assembly 200. The web 308 may be formed as a living hinge in some embodiments similarly to web 208. Bristles 111*a*, 111*b* extend upwards and outwards from front surface 306 of each bristle carrier section 301, 302.

Figure 4:
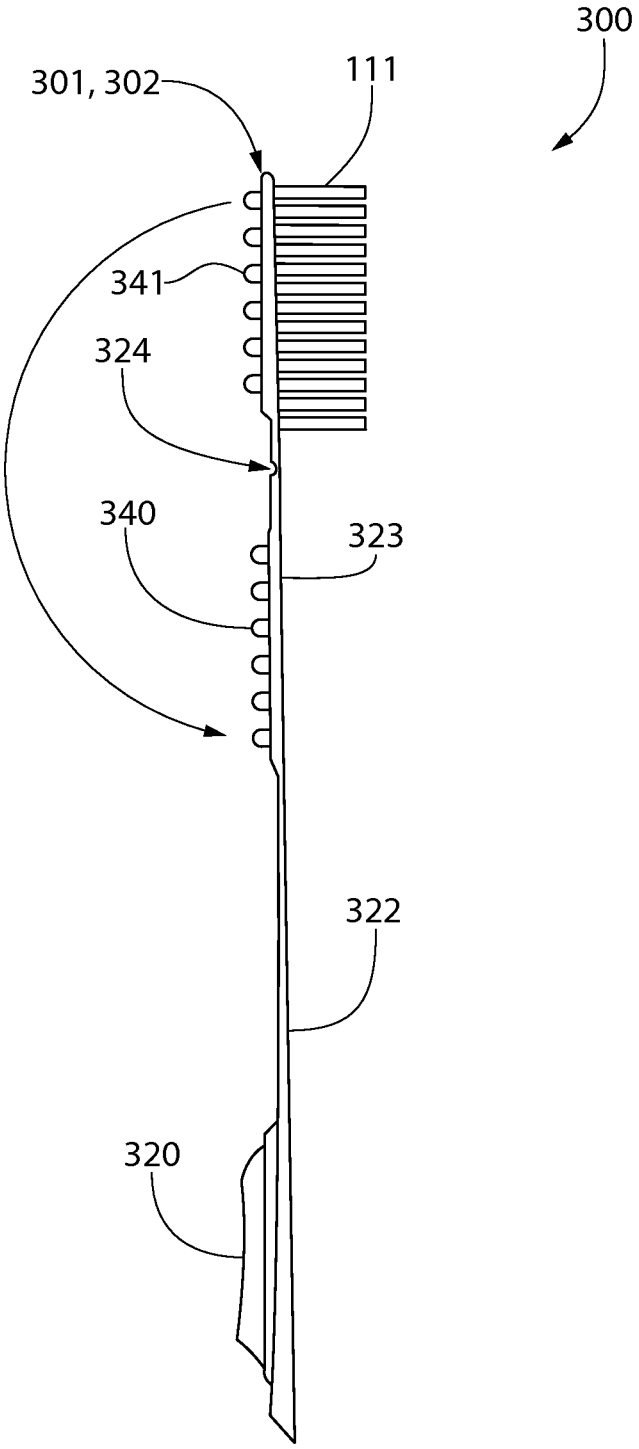
FIG. 4 is a side view of an alternative construction of the bristle carrier assembly and actuator.

In the non-limiting embodiment shown, the actuating mechanism may be integrally molded with the bristle carrier assembly 300 forming a single unitary structure as best shown in FIG. 4. This single integrated component may be structured and made of a relatively rigid or semi-rigid plastic material similarly to bristle carrier assembly 200 and operating rod 222 describe above. The present actuating mechanism includes operating rod 322 having an actuator 320 disposed on a proximal operating end and a distal working end 323 configured to engage the bristle carrier sections 301, 302. The bristle carrier assembly 300 may be connected to the working end 323 of the operating rod via a transversely oriented living hinge 324 which allows the bristle carrier assembly to be folded lengthwise over onto the working end of the rod when the toothbrush 100 is assembled. The operating rod extends through the same axial cavity 224 formed inside the handle and neck portions 120, 121 of the toothbrush 100.

With continuing reference to FIGS. 4-7, the bristle carrier assembly 300 is movable between the extended position (general purpose cleaning configuration) and folded/collapsed position (interdental cleaning bristle configuration) already described herein via mating sets of intermeshing protrusions. A first set of longitudinally and laterally spaced apart protrusions 340 is formed on an upward facing top surface of the working end 323 of the operating rod 322. A second set of longitudinally spaced apart protrusions 341 is formed on a downward facing bottom surface of each of the bristle carrier sections 301, 302. The protrusions 341 on the first and second bristle carrier sections 301, 302 are also laterally spaced apart. The protrusions 340, 341 are arranged so that in the extended position of the bristle carrier assembly 300 (i.e. bristles upright), the protrusions form two longitudinal staggered rows with protrusions 340 having inboard positions and protrusions 341 having outboard positions. This arrangement is shown in FIGS. 5A, 6A, and 7A.

Figure 5A:
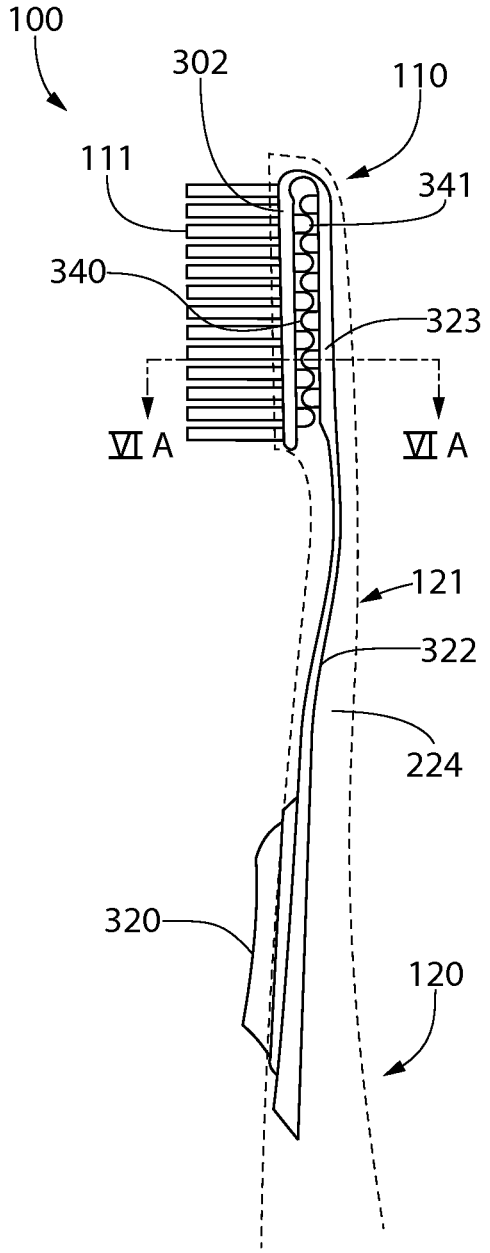
FIG. 5A is a partial longitudinal cross-sectional view thereof showing the actuator in a forward position and the bristle carriers and bristles in the open/extended position.
Figure 5B:
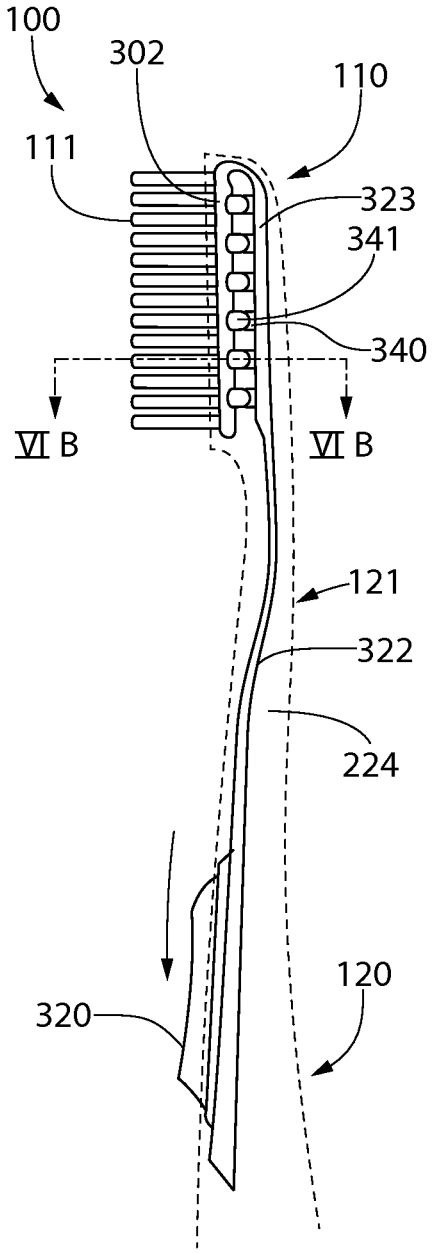
FIG. 5B is a partial longitudinal cross-sectional view thereof showing the actuator in a rearward position and the bristle carriers and bristles in the folded position.
Figure 6A:
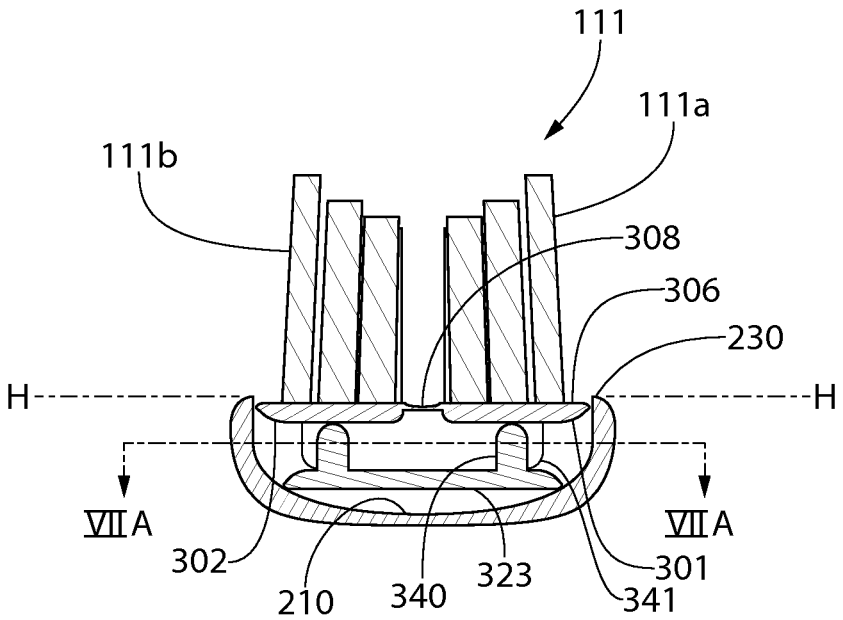
FIG. 6A is a transverse cross-sectional view of the head portion of the oral care implement showing the bristle carriers and bristles in the open/extended position.
Figure 6B:
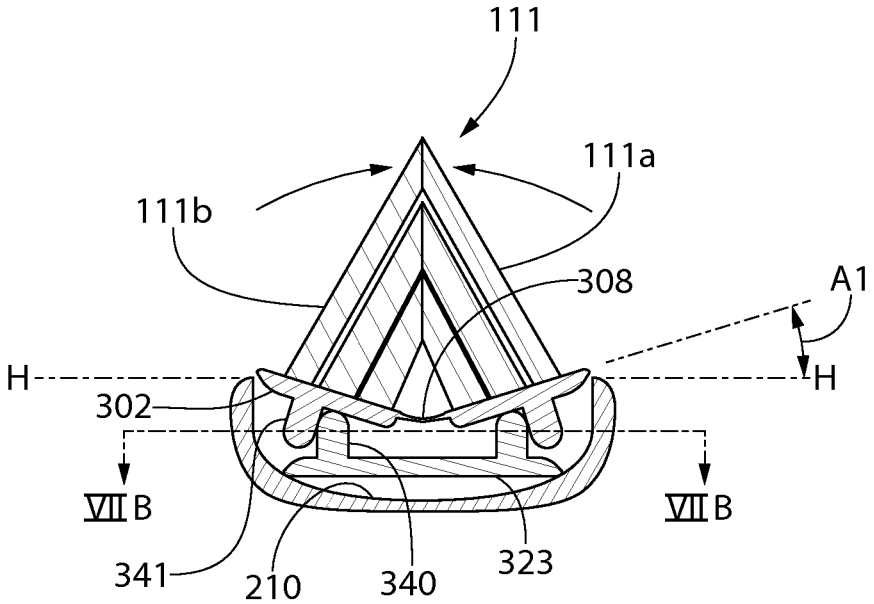
FIG. 6B is a transverse cross-sectional view of the head portion showing the bristle carriers and bristles in the folded position.
Figures 7A, 7B:
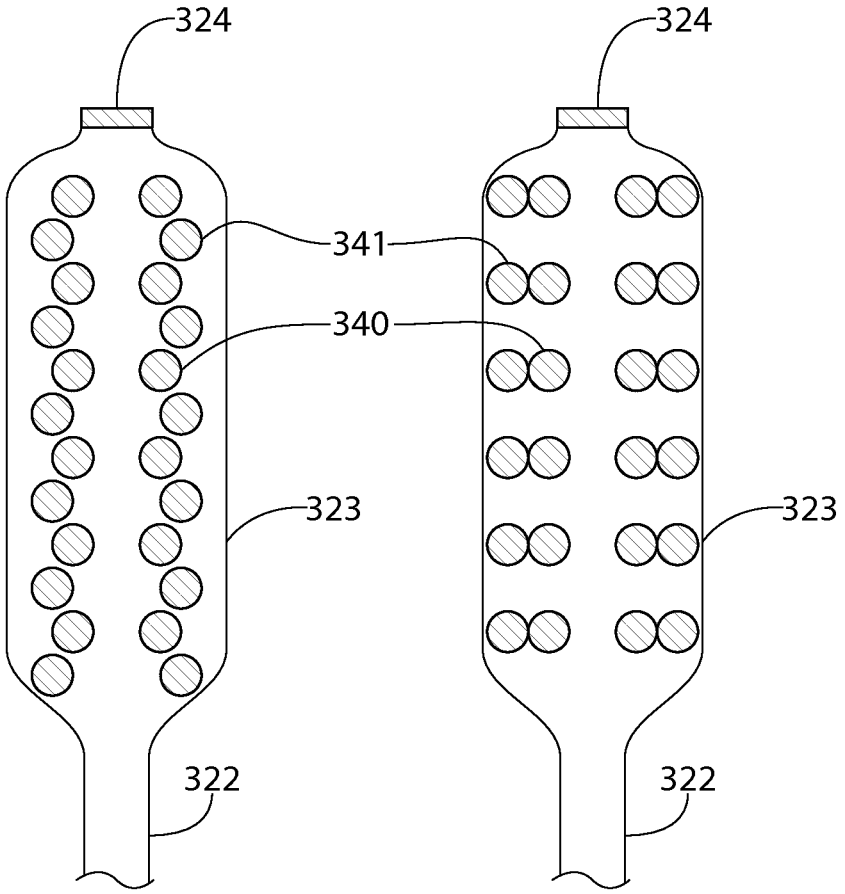
FIG. 7A is a transverse cross-sectional view taken from FIG. 6A showing the positions of operating protrusions on the bristle carriers and working end of an operating rod when the bristle carriers and bristles are in the open/extended position.
FIG. 7B is a transverse cross-sectional view taken from FIG. 6B showing the positions of operating protrusions on the bristle carriers and working end of the operating rod when the bristle carriers and bristles are in the folded position.

When the actuating mechanism is activated by sliding the actuator 320 towards the proximal end 103 of the toothbrush (in a similar manner to actuator 220 describe above), the protrusions 341 on the bristle carriers 301, 302 engage the protrusions 340 on the operating rod working end 323 and become laterally displaced outwards as shown in FIGS. 5B, 6B, and 7B. This causes the bristle carriers 301, 302 to pivot inwards about the flexible hinge 308 (i.e. pivot axis) towards the folded position (interdental cleaning bristle configuration). The protrusions 340 and 341 are now arranged in a substantially side-to-side relationship. It bears noting that the common pivot axis may be translated slightly in position either vertically, horizontally, or a combination thereof when the carrier assembly is moved between the extended and folded position by the actuating mechanism; however, the bristle carrier sections 201, 202 remain hingedly coupled together during this motion.

It further bears noting that a user may select a partially folded position between the extended position (see, e.g. FIGS. 3A and 6A) and the folded position (see, e.g. FIGS. 3B and 6B) by linearly sliding actuator 220/320 between the forward and rearward positions.

While one embodiment of an actuator mechanism in the form of a slide button or switch and rod is disclosed herein for altering the position and configuration of the bristle carriers, the invention is not limited to this type of actuator alone. Accordingly, in other possible embodiments the actuator mechanism may be a rotatable switch/button and rod operably coupled to the bristle carriers and configured to cause movement between the folded and extended cleaning positions, or other type of actuator configured to impart the desired motion to the bristle carriers. Furthermore, while the bristle carriers are disclosed in one embodiment as being hingedly coupled about a pivot axis which is parallel to the longitudinal axis of the toothbrush, in other embodiments the pivot axis could be transverse to the longitudinal axis.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

an elongated body extending along a longitudinal axis and comprising a head portion and a handle portion;

a first bristle carrier section movably disposed on the head portion, the first bristle carrier section comprising a plurality of first tooth cleaning elements extending outward from a front surface thereof;

a second bristle carrier section movably disposed on the head portion adjacent the first bristle carrier section, the second bristle carrier section comprising a plurality of second tooth cleaning elements extending outward from a front surface thereof;

the first and second bristle carrier sections hingedly coupled together about a common pivot axis;

the first and second bristle carrier sections are structured and made of a rigid plastic material; and an actuator operably coupled to the first and second bristle carrier sections, the actuator alterable between: (1) a first state in which the actuator causes the first and second bristle carrier sections to assume an extended position; and (2) a second state in which the actuator causes the first and second bristle carrier sections to assume a transversely folded position in which the first and second tooth cleaning elements converge.

2. The oral care implement according to claim 1, wherein the first and second tooth cleaning elements are oriented substantially upright and parallel to each other in the extended position, and the first and second tooth cleaning elements are oriented substantially obliquely to each other in the folded position.

3. The oral care implement according to claim 1, wherein the first and second bristle carrier sections are pivoted inwards about the pivot axis when in the folded position.

4. The oral care implement according to claim 1, wherein the common pivot axis is formed by a living hinge connecting the first and second bristle carrier sections together.

5. The oral care implement according to claim 4, wherein the living hinge comprises a resiliently flexible web that hingedly couples the first and second bristle carrier sections together, the web having greater flexibility than the first and second bristle carrier sections.

6. The oral care implement according to claim 5, wherein the actuator further comprises an operating rod, a distal working end of the operating rod includes a wedge-shaped protrusion which is selectively engageable with an underside portion of the flexible web.

7. The oral care implement according to claim 4, wherein the actuator further comprises an operating rod, a distal working end of the operating rod includes a plurality of first protrusions arranged to engage a plurality of second protrusions formed on the first and second bristle carrier sections, the first protrusions positioned between the second protrusions in the extended position of the first and second bristle carrier sections, the first protrusions positioned laterally adjacent the second protrusions in the folded position of the first and second bristle carrier sections.

8. The oral care implement according to claim 7, wherein the first and second bristle carrier sections are hingedly coupled to a distal working end of the operating rod by a transversely oriented flexible web, the first and second bristle carrier sections being folded over the working end of the operating rod when mounted in the toothbrush body.

9. The oral care implement according to claim 8, wherein the first and second bristle carrier sections and the operating rod are formed integrally as parts of a unitary structure.

10. The oral care implement according to claim 1, wherein the first and second tooth cleaning elements of the first and second bristle carrier sections when in the folded position are angled inwards toward the longitudinal axis forming a wedge-shaped bristle profile.

11. The oral care implement according to claim 1, wherein the actuator is formed as a button slidably mounted in an upwardly open recess formed in a front surface of the handle portion.

12. An oral care implement comprising:

an elongated body extending along a longitudinal axis and comprising a head portion defining a distal end, a handle portion defining a proximal end, and a neck portion extending therebetween;

a foldable bristle carrier assembly comprising first and second bristle carrier sections hingedly coupled together by a flexible web;

the first and second bristle carrier sections are structured and made of a rigid plastic material;

an actuator operably coupled to the bristle carrier assembly, the actuator alterable between a first state and a second state;

wherein moving the actuator from the first state to the second state causes the first and second bristle carrier sections to pivot inwards about the flexible web to a folded position; and wherein moving the actuator from the second state to the first state causes the first and second bristle carrier sections to pivot outwards about the flexible web to an upright open position.

13. The oral care implement according to claim 12, wherein bristles mounted on the first and second bristle carrier sections are oriented substantially parallel to each other in the upright open position.

14. The oral care implement according to claim 13, wherein the bristles on the first and second bristle carrier sections are oriented substantially obliquely to each other in the folded position.

15. The oral care implement according to claim 12, wherein flat front surfaces of the first and second bristle carrier sections are oriented substantially parallel to a horizontal reference plane defined by opposing front lateral peripheral edges of the head portion of the body.

16. The oral care implement according to claim 15, wherein the first and second bristle carrier sections are located on opposite sides of a first reference plane that includes the longitudinal axis and is orthogonal to the front surface of the head portion, and wherein the first reference plane intersects the flexible web of the bristle carrier assembly.

17. A method for operating an oral care implement with angularly adjustable bristles, the method comprising:

a) providing an elongated oral care implement comprising a longitudinal axis, a head defining a distal end, a handle defining a proximal end, a foldable bristle carrier assembly comprising first and second bristle carrier sections each having a plurality of bristles and hingedly coupled together about a common pivot axis, the first and second bristle carrier sections are structured and made of a rigid plastic material, and an actuator operably coupled to the bristle carrier assembly;

b) placing the actuator in a first state, thereby causing the bristles of the first and second bristle carrier sections to be oriented substantially perpendicular to the head of the oral care implement; and c) altering the actuator to a second state, thereby causing each of the first and second bristle carrier sections to pivot inwards about the common pivot axis so that the bristles of the first and second bristle carrier sections assume a wedge-shaped folded position.

18. The method according to claim 17, wherein step c) comprises sliding the actuator from the first state to the second state.

19. The method according to claim 17, wherein the pivot axis is positioned below outer peripheral edges of the first and second bristle carrier sections when in the folded position.

* * * * *